US006571985B2

(12) United States Patent
Wilkes et al.

(10) Patent No.: US 6,571,985 B2
(45) Date of Patent: Jun. 3, 2003

(54) DISPOSABLE WIPER DISPENSER CARTON

(75) Inventors: Patsy McEachern Wilkes, Woodstock, GA (US); Craig F. Thomaschefsky, Marietta, GA (US); Malcolm Colin Halls, Alpharetta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 71 days.

(21) Appl. No.: 09/747,720

(22) Filed: Dec. 22, 2000

(65) Prior Publication Data

US 2002/0079322 A1 Jun. 27, 2002

(51) Int. Cl.[7] ..... B65H 1/00
(52) U.S. Cl. ..... 221/63; 221/303
(58) Field of Search ..... 221/33, 45, 63, 221/503, 48; 206/494, 812, 449, 409

(56) References Cited

U.S. PATENT DOCUMENTS

| | | | | | |
|---|---|---|---|---|---|
| 2,953,293 | A | * | 9/1960 | Anderson | 221/63 |
| 3,161,336 | A | | 12/1964 | Loescher | |
| 3,369,698 | A | | 2/1968 | Scholz | |
| 3,369,699 | A | | 2/1968 | Enloe et al. | |
| 4,289,262 | A | * | 9/1981 | Finkelstein | 221/63 |
| 4,469,243 | A | | 9/1984 | Ito et al. | |
| 4,478,354 | A | | 10/1984 | Notheis | |
| 4,513,862 | A | | 4/1985 | Mallow | |
| 5,687,875 | A | * | 11/1997 | Watts et al. | 221/45 |
| 5,740,913 | A | | 4/1998 | McFarland | |
| 5,897,023 | A | * | 4/1999 | Lee | 221/63 |
| 6,299,017 | B1 | * | 10/2001 | Hill | 221/63 |

* cited by examiner

*Primary Examiner*—Kenneth W. Noland
(74) *Attorney, Agent, or Firm*—Dority & Manning, PA

(57) ABSTRACT

A dispenser for folded interconnected disposable wipes includes at least one dispensing container having side and end walls, and a dispensing wall adjacent to the side and end walls. The dispensing wall has a center dispensing aperture located generally in the center thereof. The dispensing wall may also have an additional dispensing aperture, for example an off-center aperture or a corner dispensing aperture located near one corner of the dispensing wall adjacent to one of the end walls and one of the side walls. Disposable wipes can be withdrawn from either the corner and/or off-center dispensing aperture or the center dispensing aperture.

19 Claims, 5 Drawing Sheets

DISPOSABLE WIPER DISPENSER CARTON

TECHNICAL FIELD

This invention relates to a dispenser for disposable wipes made, for example, from paper or non-woven material and like products. More specifically, the present invention relates principally to an improved disposable wiper dispenser for wipe products.

BACKGROUND OF THE INVENTION

Disposable wiper style dispensers are well known in the art for dispensing individual folded sheet products such as facial tissues, hand wipes, or the like. In general, disposable wiper dispensers typically include a container and a stack or clip of pre-folded, inter-folded wipes disposed within the container. The wipes may be C-folded or V-folded so that once the top wipe in the clip is withdrawn, the underlying wipe is individually presented for subsequent use.

With one type of conventional product, a number of wipes are offered for sale in an inter-folded format. They are formed by unwinding two base rolls, perforating the wipes, and then inter-folding them into uniform stacks. The stacks of connected, perforated wipes are then loaded into corrugated cartons that allow for easy wiper access. In use, the wipers are dispensed through a fairly large oval or diamond-shaped opening centrally located in the top panel of the carton.

To access the wipers, the user reaches into the carton through the opening to access the top wiper. The user then pulls the top wiper through the opening. Due to the wipers being connected at perforation tabs and inter-folded one after another, the first wiper ideally pulls the second wiper to an accessible point and then breaks away from the second wiper. However, due to variability in the dimensions of the wipes, non-woven structure variability, size of perforation tabs, individual user "grasp and pull" methods, etc., continuous dispensing of one wiper after another is typically not achieved.

One of the more common problems found in disposable wiper dispensers concerns the issue of "fall back". This involves the situation where a following wipe drops back through the dispensing slot after the leading wipe has been withdrawn.

Another common problem among disposable wiper dispensers involves the issue of "double pull." This occurs when more than one wipe comes out when the leading wipe is withdrawn.

Additionally, the problem of "streaming" can occur in disposable wiper dispensers. Streaming occurs when the user pulls the first wipe out, and subsequent wipes are also withdrawn, with separation of the following ones never occurring.

Another problem among these types of dispensers are what is known in the art as "multiple pulls". If three or more wipes come out after the lead wipe is pulled, and this happens more than four (4) times per dispenser, the problem of multiple pulls is said to exist.

All of these situations are defined as quality defects, and they are considered to be major inconveniences to the user and have resulted in user complaints.

A need in the art exists for a disposable wiper dispenser that eliminates these problems and improves the performance of past disposable wiper dispensers.

OBJECTIVES AND SUMMARY OF THE INVENTION

Objectives and advantages of the invention will be set forth in part in the following description, or may be obvious from the description, or may be learned from practice of the invention.

In response to the discussed deficiencies in the prior art, a new disposable wiper dispenser has been developed. The dispenser improves the ease at which wipe products are dispensed.

A disposable wiper dispenser according to the invention consists of at least one dispensing container which has side and end walls. The side and end walls are of substantial depth to accommodate a type and style of folded interconnected wipers. In one particular embodiment, a dispensing wall has a center dispensing aperture located generally in the center of the wall and a corner dispensing aperture located near one corner of the dispensing wall adjacent to one of the end walls and one of the side walls of the dispensing container. The corner aperture may take on various shapes, for example triangular, quarter-round, etc. The dispensing container also has a bottom wall located opposite from the dispensing wall.

With still another embodiment according to the invention, the dispensing wall may have an off-center dispensing aperture located next to the center dispensing aperture. This off-center dispensing aperture may be in place of or in addition to the corner dispensing aperture described above. The off-center dispensing apertures may take on various shapes, including a triangle having at least one rounded corner.

With an alternative embodiment of the present invention, a dispenser for disposable wipes is made of a plurality of the afore-mentioned dispensing containers.

Here, the dispensing containers are arranged next to one another, each dispensing container sharing a side wall with the dispensing container located next to it. Each dispensing wall of the plurality of containers may have any combination of a center dispensing aperture, corner dispensing aperture, and/or off-center dispensing aperture.

BRIEF DESCRIPTION OF THE DRAWINGS

The preferred embodiments of the present invention are described by way of example with reference to the accompanying drawings in which.

Figure 1:
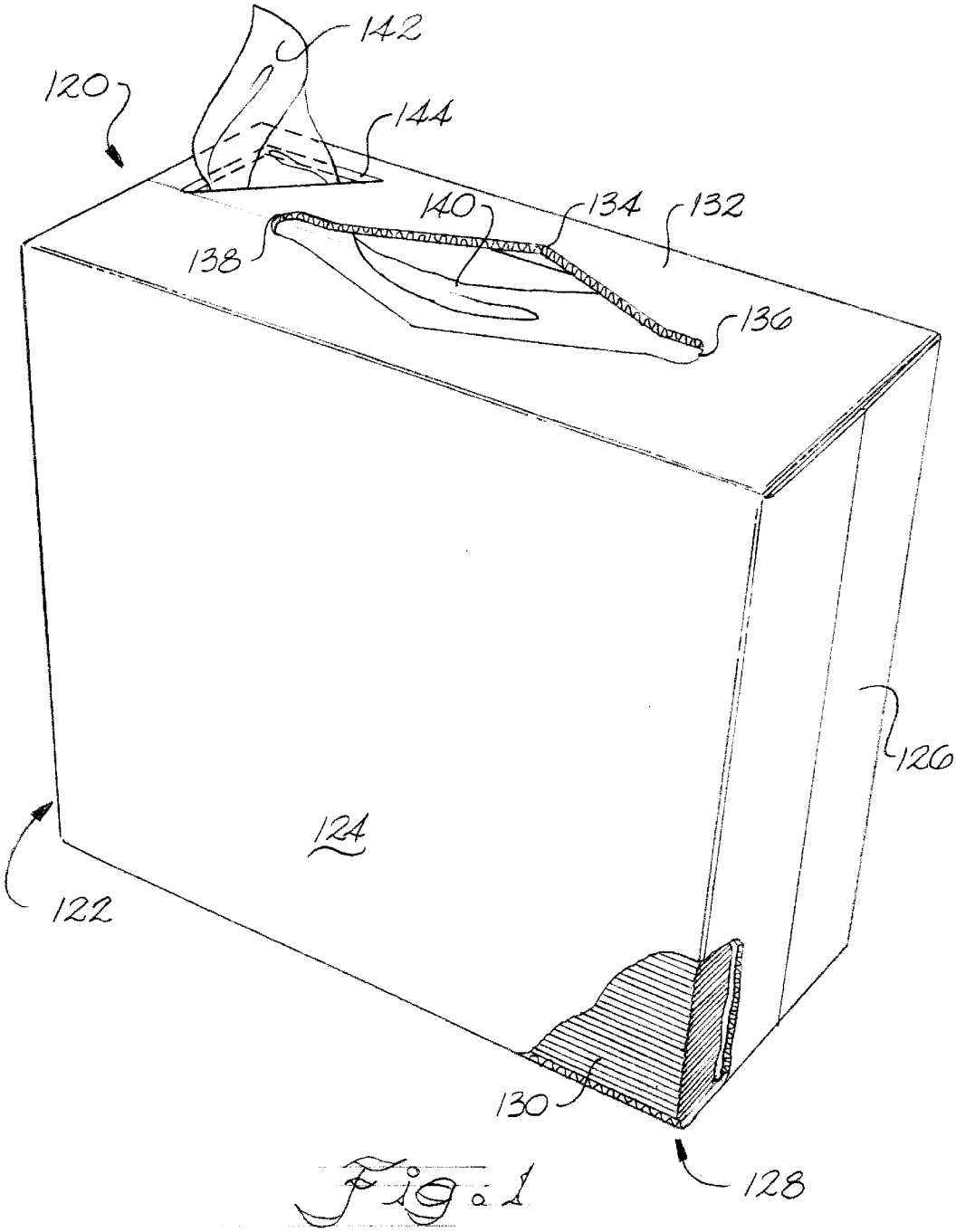
FIG. 1 is a perspective view of a dispenser for disposable wipes in accordance with the present invention.

The drawing shows a dispensing container having a corner aperture. The drawing also shows a clip of wipes being located within the dispensing container and being removed from the corner aperture.

Figure 2:
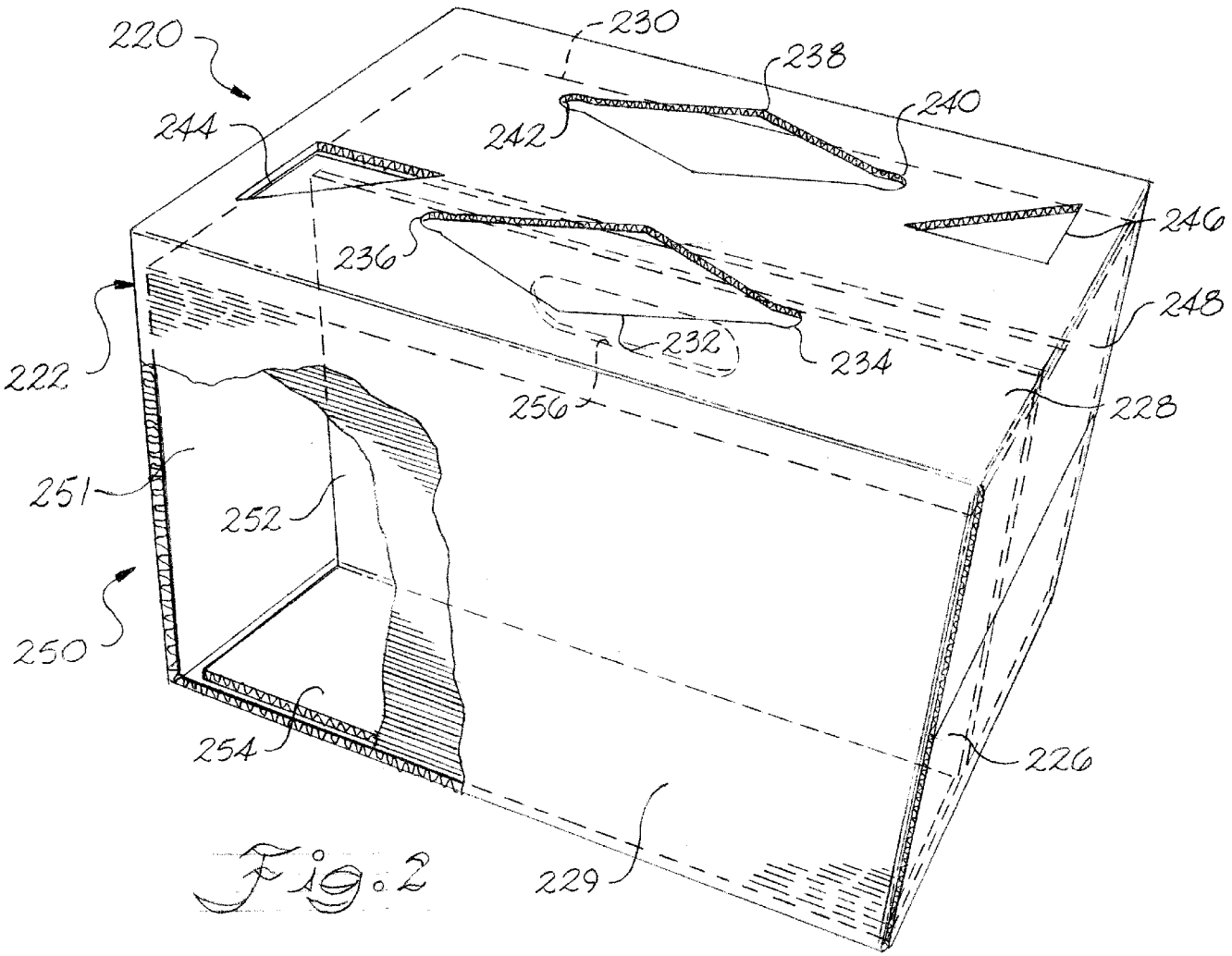

FIG. 2 is a perspective and partial cut-away view of an alternate embodiment of a dispenser for disposable wipes in accordance with the present invention. The drawing shows a plurality of dispensing containers located adjacent to one another sharing a common side wall. The dispensing containers each have a center and corner aperture.

Figure 3:
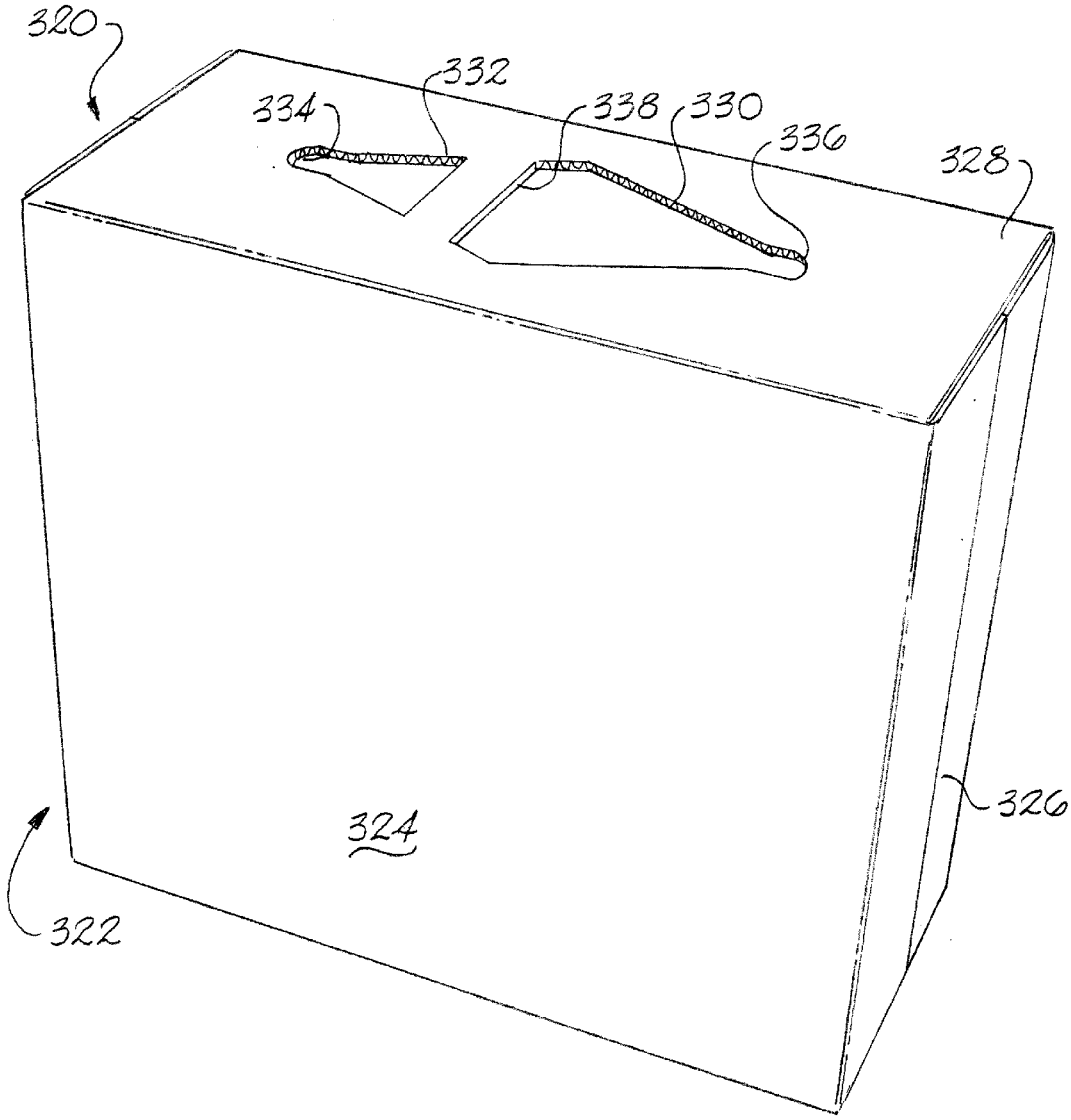

FIG. 3 is a perspective view of an alternate embodiment of a dispenser for disposable wipes in accordance with the present invention. The drawing shows a dispensing container having a center aperture and an off-center aperture.

Figure 4:
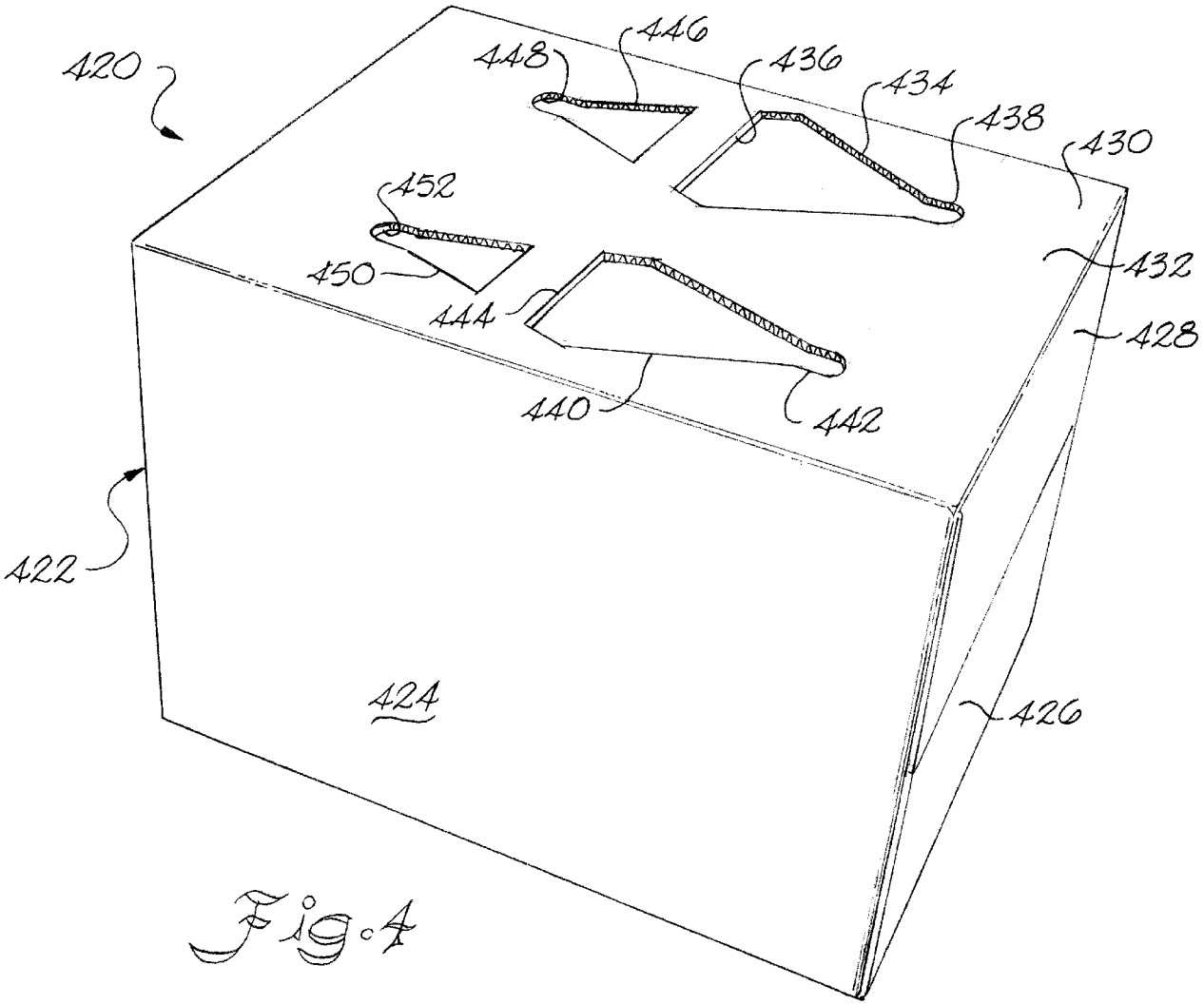

FIG. 4 is a perspective view of an alternate embodiment of a dispenser for disposable wipes in accordance with the present invention. The drawing shows a plurality of dispensing containers located next to one another. Each of the dispensing containers has a center dispensing aperture and an off-center dispensing aperture.

Figure 5:
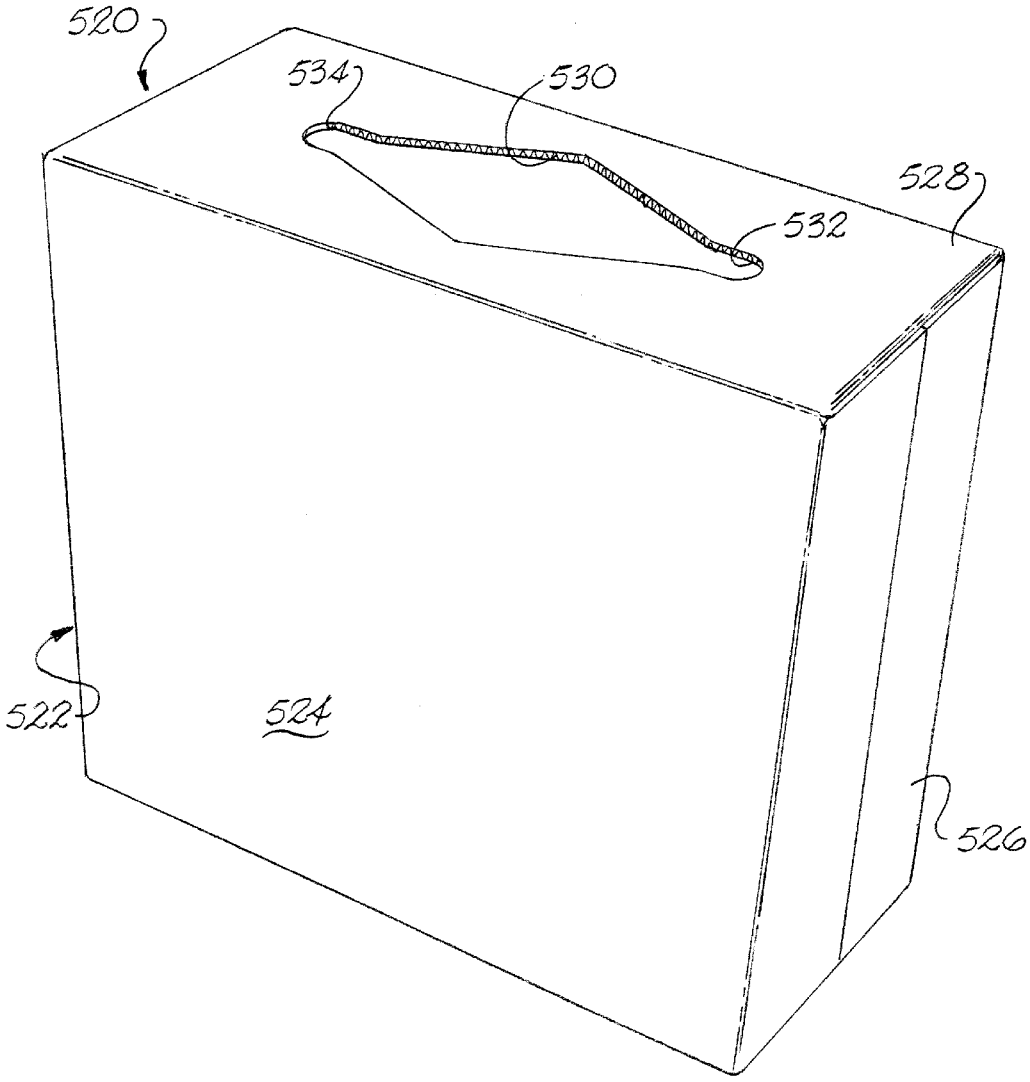

FIG. 5 is a perspective view of a bottom side of a dispenser in accordance with the present invention that may be used on any dispenser embodiment according to the invention.

DETAILED DESCRIPTION

Reference will now be made in detail to embodiments of the invention, one or more examples of which are illustrated in the drawings. Each example is provided by way of explanation of the invention, and is not meant as a limitation of the invention. For example features illustrated or described as part of one embodiment can be used with another embodiment to yield still a third embodiment. It is intended that the present invention include such modifications and variations.

Referring now to the drawings, FIG. 1 shows a perspective view of a dispenser for disposable wipes 120 in accordance with the present invention. The dispenser 120 consists of a dispensing container 122. The dispensing container 122 is generally in the shape of an elongated box and has two side walls 124 adjacent to two end walls 126. A bottom wall (not shown in FIG. 1) is located adjacent to all of the side walls 124 and end walls 126. Due to the orientation of the dispensing container 122 in FIG. 1, one of the side walls 124 and end walls 126 are not shown.

On the opposite end from the bottom wall, a dispensing wall 132 is located. Dispensing wall 132 is adjacent to all of the end walls 126 and side walls 124 of the dispensing container 122. The dispensing wall 132 has a central aperture 134 located generally in the center of the dispensing wall 132. In one embodiment, the central aperture 134 may have a curved end 138 on one end, and a curved end 136 on the other. The central aperture 134 is therefore shown as being diamond shaped w two curved corners.

The dispensing container 122 may also have a corner aperture 144 located in a corner of the dispensing wall 132. The corner aperture 144 is also located next to an end wall 126 and a side wall 124. The corner aperture 144 is generally triangular in shape. It is to be understood that although described as generally diamond and triangular shaped respectively, central aperture 134 and corner aperture 144 may be any of a variety of different shapes including oval, square, or rectangular.

A portion of side wall 124 and end wall 126 is removed in FIG. 1, indicated as numeral 128. This cutout shows a clip of interfolded wipes 130 disposed within dispensing container 122. The clip of interfolded wipes 130 rests on the bottom of the dispensing container 122. A lead wipe 140 is shown at the top of the dispensing container 122. This single wipe is shown as being removed from the dispensing container 122 through corner aperture 144. An end 142 of the single wipe 140 is shown being pulled from the clip of interfolded wipes 130.

The dispenser for disposable wipes 120 shown in FIG. 1 reduces or eliminates the problems associated with previous disposable wiper dispensers. The problems of fall-back, double pull, multiple pulls, and streaming are either eliminated or reduced through use of corner aperture 144. The reasons for this exists in the cornering position of corner aperture 144. Locating the dispensing port in a corner of the dispensing container 122 an pulling the wipes toward an end of dispensing container 122 causes an optimal amount of resistance on the single wipes with the dispensing container 122. This optimal amount of resistance, along with the angle of pull, creates an improved separation between the single wipe 140 and the clip of interfolded wipes 130. As a result, the aforementioned problems of fall-back, double pull, multiple pulls, and streaming are either reduced or eliminated.

The center aperture 134 is provided on the dispensing container 122 in order to reach into the dispensing container 122 and grab a lead wipe 140. Also, the center aperture 134 is provided to allow a user to dispense wipes 140 in a conventional manner. The center aperture 134 is present in case the condition of fall-back does in fact occur with the clip of interfolded wipes 130 or to begin dispensing of the clip of interfolded wipes 130 when a user first purchases the dispenser 120.

Referring to FIG. 2, an alternative embodiment of the present invention showing a variation of the dispenser for disposable wipes of FIG. 1 is shown. This dispenser for disposable wipes is indicated generally at 220. It consists of a plurality of dispensing containers 222. Each of the plurality of dispensing containers 222 incorporates two side walls 224 in addition to two end walls 226. Due to the orientation of the dispenser in FIG. 2, only one side wall 224 is visible on the outside of the plurality of dispensing containers 222 and only two end walls 226 and 248 are shown on the plurality of dispensing containers 222 (another end wall 251 is shown in the cut-out section 250 of FIG. 2 as will be later discussed). A bottom (not shown in FIG. 2) is located adjacent to the end walls 226 and 248 and side walls 224. Opposite to the bottom walls are two dispensing walls 228 and 230. Each one of the dispensing walls 228 and 230 include an aperture arrangement as shown in FIG. 1. For example, each dispensing wall has a central aperture 232 and 238 which have a pair of rounded corners (236 and 234, and 242 and 240). Located in each corner of the dispensing walls 228 and 230, there are included a corner dispensing aperture 244 and 246. As with the previous embodiments, the central apertures 232 and 238, and the corner dispensing apertures 244 and 246 can be of any variety of shape.

Because each of the plurality of dispensing containers 222 is located next to one another, each share a side wall 252. The side wall 252 is visible in FIG. 2 due to a cut out portion of the side wall which is shown, indicated generally at 250. The cut out portion 250 shows three intersecting planes. The three planes shown by cut out portion 250 are the side wall 252, a bottom portion 254 the sidewall 252, and an end wall 251 opposite to end wall 226.

Side wall 252 has a bottom portion 254 located at the bottom of one of the plurality of dispensing containers 222. Also, side wall 252 may be provided with a handle 256, for example in the form of a cut out of side wall 252.

Handle 256 can be used by a user to transport the dispenser 220. In order to accomplish this, the user must insert his or her hand through one of the central apertures 238 or 232 and then grasp handle 256. It should be understood that in order for handle 256 to be used, the amount of wipes 140 in dispenser 220 must be removed to a point where they do not block the cut out forming handle 256.

The embodiment of the dispenser 220 allows for a single container to have more than one type of clip of interfolded wipes 130. For instance, a clip of hand towels can be located in one dispensing container 222 and a clip of facial tissue can be located in another dispensing container 222. Additionally, clips of different colors can be employed in either dispensing container. Also, the same type of clips can be disposed in all of the dispensing containers 222 to allow for a dispenser which has double the amount of disposable wipes 140. A dispenser 220 with such different variations of clips both described and obvious to those skilled in the art are to be considered within the scope of the present invention.

Referring now to FIG. 3, an alternative embodiment for a dispenser for disposable wipes 320 is provided in accordance with the present invention. The dispenser 320 is composed of a dispensing container 322 having a side wall 324 and an end wall 326. Due to the orientation of dispensing container 322 in FIG. 3, the other side wall 324 and end wall 326 are not shown. Additionally, a bottom wall (not shown in FIG. 3) is provided. Opposite the bottom wall is a dispensing wall 328.

The dispensing wall 328 has a center dispensing aperture 330 located generally in the center of the dispensing wall. In one desirable embodiment, the center dispensing aperture 330 is generally diamond shaped with one corner 336 being rounded. The center dispensing aperture 330 also has an opposite flattened corner 338. Also located on dispensing wall 328 is an off-center dispensing aperture 332. The off-center dispensing aperture may also be generally triangular shaped, having one corner being rounded 334. It is to be understood that the center dispensing aperture 330 and the off-center dispensing aperture 332 can be of any of a variety of shapes including round, oval, square, or rectangular.

In use, wipes 140 are dispensed through either the off-center dispensing aperture 332 or the center dispensing aperture 330. Wipes dispensed through the off-center dispensing aperture 332 experience less fall-back, double pulls, multiple pulls, and streaming than wipes 140 dispensed from the center dispensing aperture 330. This is because by pulling the wipes 140 on the ends, an optimal amount of friction is produced between the wipes 140 and the dispensing container 322 to tear the interfolded clip of wipes 130. The center dispensing aperture is provided to allow a user to retrieve wipes 140 that may have fallen back into the dispensing container 322 and also to begin the dispensing process. Also, a user can use this aperture to pull wipes 140 from the dispensing container 322 in the conventional manner.

FIG. 4 shows a dispenser for disposable wipes 420 in accordance with an alternative embodiment of the present invention. The dispenser for disposable wipes 420 is composed of a plurality of dispensing containers 422. A side wall 424 and two end walls 426 and 428 are shown. It is to be understood that the other end walls 426 and 428 and side walls 424 are present in the dispensing containers 422, but not shown due to the orientation of the dispenser for disposable wipes 420 in FIG. 4. Bottom walls (not shown) are also provided on one end of the plurality of dispensing containers 422.

Opposite the bottom walls are dispensing walls 432 and 430. Each of the dispensing walls 432 and 430 are provided with a series of apertures identical to those shown in FIG. 3. Center dispensing apertures 440 and 434 are shown with a rounded corner 442 and 438, and a flattened corner 444 and 436. Additionally, off-center dispensing apertures 446 and 450 are provided. Each of the center dispensing apertures may have a rounded corner 448 and 452. This embodiment of the present invention provides for the same advantages as discussed with the embodiment shown in FIG. 2, however, the dispensing properties will be similar to the dispenser for disposable wipes 320 that is shown in the embodiment of FIG. 3.

The embodiments shown in FIG. 3 and FIG. 4 may be provided with a corner dispensing aperture as shown in FIG. 1 and FIG. 2 on the dispensing walls 328, 430, and 432. The corner dispensing aperture may be of any shape. Also, it is to be understood that the center dispensing apertures 440, 434, and 330 and off-center dispensing apertures 332, 450, and 446 may be any of a variety of shapes including round, oval, square, or rectangular.

Referring to FIG. 5, a dispenser for disposable wipes 520 is shown. This view shows a dispensing container 522 in an upside down position in accordance with one embodiment of the present invention. A side wall 524 and an end wall 526 are shown. Also, the bottom wall 528 of the dispensing container 522 is shown. The bottom wall 528 has a bottom dispensing aperture 530. The bottom dispensing aperture 530 is located in the center of the bottom wall 528 and has two rounded corners 534 and 532. The purpose of the bottom dispensing aperture 530 is to allow a user to invert the dispensing container 522 to dispense disposable wipes 140 in a conventional manner. A bottom dispensing aperture 530 can be provided on the bottom wall 528 of any of the aforementioned embodiments of the present invention. It is to be understood that the bottom dispensing aperture 530 may be of any shape including round, oval, square or rectangular.

The dispenser for disposable wipes as previously described may be used by placing it on a flat surface and pulling wipes 140 upward. Additionally, the dispenser may be mounted on a vertical wall or upside down in order to remove wipes 140 in any number of directions.

It will be appreciated that various modifications and changes may be made to the above described preferred embodiments of a dispenser for disposable wipes without departing from the scope of the following claims.

What is claimed is:

1. A dispenser for folded interconnected disposable wipes, the dispenser comprising:

at least one dispensing container having side and end walls and a dispensing wall adjacent to the side and end walls, the dispensing wall having a corner dispensing aperture adjacent to one of the end walls and one of the side walls, the dispensing wall also having a center dispensing aperture generally located in the center of the dispensing wall, the dispensing container also having a bottom wall located opposite the dispensing wall.

2. The dispenser for disposable wipes as set forth in claim 1, wherein the corner dispensing aperture is generally triangular in shape.

3. The dispenser for disposable wipes as set forth in claim 2, wherein the center dispensing aperture is generally diamond shaped.

4. The dispenser for disposable wipes as set forth in claim 1, wherein the dispensing container is formed from a cardboard material.

5. The dispenser for disposable wipes as set forth in claim 1, wherein the dispensing container is formed from a plastic material.

6. The dispenser for disposable wipes as set forth in claim 1, further comprising a clip of inter-folded disposable wipes disposed within the dispensing container.

7. The dispenser for disposable wipes as set forth in claim 1, wherein the bottom wall has a bottom dispensing aperture.

8. The dispenser for disposable wipes as set forth in claim 1, further comprising a plurality of clips of inter-folded disposable wipes, each clip disposed within one of the dispensing containers, each of the clips are made of the same type of inter-folded disposable wipes.

9. The dispenser for disposable wipes as set forth in claim 1, further comprising a plurality of clips of inter-folded disposable wipes, each clip disposed within one of the dispensing containers, the clips are made of different types of inter-folded disposable wipes.

10. A dispenser for folded interconnected disposable wipes, the dispenser comprising:

at least one dispensing container having side and end walls and a dispensing wall adjacent to the side and end walls, the dispensing wall having a center dispensing aperture generally located in the center of the dispensing wall, the dispensing wall also having an off-center dispensing aperture located next to the center dispensing aperture, the dispensing container also having a bottom wall located opposite the dispensing wall.

11. The dispenser for folded interconnected disposable wipes as set forth in claim 10, wherein the off-center dispensing aperture is in the shape of a triangle having one rounded corner.

12. The dispenser for folded interconnected disposable wipes as set forth in claim 11, wherein the center dispensing aperture is in the shape of a diamond having one rounded corner and having a flattened opposite corner.

13. The dispenser for folded interconnected disposable wipes as set forth in claim 10, wherein the dispensing container is formed from a cardboard material.

14. The dispenser for folded interconnected disposable wipes as set forth in claim 10, wherein the dispensing container is formed from a plastic material.

15. The dispenser for folded interconnected disposable wipes as set forth in claim 10, further comprising a clip of inter-folded disposable wipes disposed within the dispensing container.

16. The dispenser for folded interconnected disposable wipes as set forth in claim 10, wherein the bottom wall has a bottom dispensing aperture.

17. The dispenser for folded interconnected disposable wipes as set forth in claim 10, wherein the dispensing wall has a corner dispensing aperture adjacent to one of the end walls and one of the side walls, the corner dispensing aperture is generally triangular in shape.

18. The dispenser for folded interconnected disposable wipes as set forth in claim 10, further comprising a plurality of clips of inter-folded disposable wipes, each of the clips are disposed within one of the dispensing containers, each of the clips are made of the same type of inter-folded disposable wipes.

19. The dispenser for folded interconnected disposable wipes as set forth in claim 10, further comprising a plurality of clips of inter-folded disposable wipes, each clip is disposed within one of the dispensing containers, each of the clips are made of a different type of inter-folded disposable wipes.

* * * * *